343-700 MS AU 251 EX
9/15/87 XR 4,694,301

United States Patent [19]
Wassum

[11] Patent Number: 4,694,301
[45] Date of Patent: Sep. 15, 1987

[54] ANTENNA PARTICULARLY SUITED FOR USE WITH A MOBILE COMMUNICATIONS SYSTEM

[75] Inventor: Raymond E. Wassum, Chagrin Falls, Ohio

[73] Assignee: Antenna Incorporated - Div. of Celwave, Cleveland, Ohio

[21] Appl. No.: 812,528

[22] Filed: Dec. 23, 1985

[51] Int. Cl.[4] ..... H01Q 1/00; H01Q 1/38
[52] U.S. Cl. ..... 343/720; 343/700 MS; 343/702; 343/822; 343/824
[58] Field of Search ..... 343/700 MS File, 702, 343/713, 720, 824, 825, 827, 829, 830, 831, 822

[56] References Cited

U.S. PATENT DOCUMENTS

| | | | |
|---|---|---|---|
| 2,039,988 | 5/1936 | Graves, Jr. | 343/897 |
| 2,128,554 | 8/1938 | Baylis | 343/702 |
| 2,292,163 | 8/1942 | Shea | 343/702 |
| 2,486,536 | 11/1949 | Olson | 343/702 |
| 3,016,536 | 1/1962 | Fubini | 343/801 |
| 3,179,943 | 4/1965 | Buzbee | 343/792 |
| 3,283,330 | 11/1966 | Chatelain | 343/700 MS File |
| 3,484,787 | 12/1969 | Vallese | 343/751 |
| 4,063,246 | 12/1977 | Greiser | 343/700 MS File |
| 4,083,046 | 4/1978 | Kaloi | 343/700 MS File |
| 4,205,317 | 5/1980 | Young | 343/720 |
| 4,291,311 | 9/1981 | Kaloi | 343/829 |
| 4,371,877 | 2/1983 | Doussot et al. | 343/770 |
| 4,491,849 | 1/1985 | Tilston et al. | 343/830 |
| 4,546,357 | 10/1985 | Laughon et al. | 343/702 |

*Primary Examiner*—Robert E. Wise
*Assistant Examiner*—Doris J. Johnson
*Attorney, Agent, or Firm*—Watts, Hoffmann, Fisher & Heinke Co.

[57] ABSTRACT

A flat antenna particularly suited for mounting to a briefcase as part of a cellular telephone. The antenna has a radiator conductor and ground-plane conductor spaced from each other and mounted at right angles on an insulating support, preferably cardboard. The cardboard also serves as a mounting structure for a cable having two conductors, one soldered to the ground-plane conductor and a second soldered to the radiator. The flat structure is mounted in a panel of a carrying case and the cable is routed to a suitable transceiver.

11 Claims, 3 Drawing Figures

ANTENNA PARTICULARLY SUITED FOR USE WITH A MOBILE COMMUNICATIONS SYSTEM

DESCRIPTION

1. Technical Field

The present invention relates to a ground-plane antenna that can be mounted on a flat surface. Such an antenna can be mounted, for example, in a carrying case and used with a radio telephone carried in the carrying case.

2. Background Art

The design and construction of antennas is an art which, to a degree, is often implemented by trial and error. The most efficient antennas are specifically desiged to send and receive communication signals of a specific wavelength.

When a stationary antenna is near the ground, energy radiated toward the earth is reflected and the total field at any location is represented by the vector sum of a direct wave plus a reflected wave. In determining the effect of the signal reflections, it is common to interpret the reflected wave as generated by a mirror image antenna located below the surface of the ground. Currents in corresponding parts of the actual and image antennas (i.e., parts on the same vertical line and the same distance from the ground-plane) are of the same magnitude. In calculations involving these so-called ground-plane antennas it is typically assumed the ground is a perfect reflector and experience has shown this assumption introduces relatively minor discrepancies between theory and actual field patterns.

Ground-plane antennas are now commonly used in applications other than stationary antennas where the ground is the earth. In a mobile communications application, for example, the vehicle fender to which the antenna is mounted serves as a ground-plane.

Radiation field modification techniques other than the use of ground-planes are known in the antenna art. It is known, for example, to use one or more parasitic antennas mounted in close proximity and parallel to a driven antenna to modify the field radiating from the driven antenna. One simple parasitic antenna arrangement consists of a single driven antenna associated with a single parasitic antenna. With close-spaced arrangements, a parasitic antenna that is resonant at a lower frequency than the transmission frequency acts as a reflector and reduces the field strength in the direction of the parasitic antenna. If the parasitic antenna is reasonant at a higher frequency than the transmission frequency then the parasitic antenna acts as a director that concentrates the radiated field in the direction of the parasitic antenna.

DISCLOSURE OF THE INVENTION

The present invention relates to an antenna having a radiator for transmitting communication signals and a closely positioned planar conductor oriented perpendicular to the radiator to function as a ground-plane. The planar conductor and radiator are co-planar so the antenna has applications previously thought to be unsuited for ground-plane antennas. A preferred use of the invention is in a carrying case for use with a radio telephone.

An antenna constructed in accordance with the invention can be mounted on a flat surface of a carrying case and in one embodiment the antenna is mounted to a planar substrate of electrically nonconducting material. A first elongated signal radiating conductor is mounted to the planar substrate and is coupled to a transceiver that sends and receives communication signals.

A second elongated conductor mounted to the planar structure is oriented at right angles to the first elongated conductor and is spaced from that conductor an amount to impedance match the antenna with cabling leading to the radio. This second conductor acts as a ground-plane and reflects signals radiated during communications transmission from the first conductor. A signal carrying cable having first and second conductors is coupled to the antenna. One conductor acts as a ground conductor and is coupled to the ground-plane conductor and a second conductor carries a communications signal.

An important feature of the invention is the impedance matching between the signal carrying conductor and the antenna. The spacing between the ground-plane conductor and the radiating conductor is chosen so that the inductive impedance of the cable matches the impedance of the gap between the conductors and produces the most efficient energy transmission to the radiator.

The nonconducting planar substrate can be mounted in a wall of a carrying case. A radio carried inside the carrying case is coupled to the antenna by standard coaxial 50 ohm cabling. In a preferred embodiment of the invention the substrate is separate from the carrying case i.e., is mounted to a wall of the carrying case. It is within the scope of the invention, however, for the antenna's ground-plane and radiating conductors to be embedded in or attached to nonconducting walls of the carrying case.

A preferred antenna operates as a $\frac{5}{8}$ wavelength conductor for radio signals in the cellular telephone frequency range of approximately 800 megahertz. For other applications the length of the signal radiating conductor can be modified to radiate at other frequencies.

From the above it should be appreciated that one object of the invention is a substantially planar antenna suitable for use as a briefcase mounted antenna. This and other objects, advantages and features of the invention will become better understood when a detailed description of a preferred embodiment of the invention is described in conjunction with the accompanying drawings.

BEST MODE FOR CARRYING OUT THE INVENTION

Figure 1:
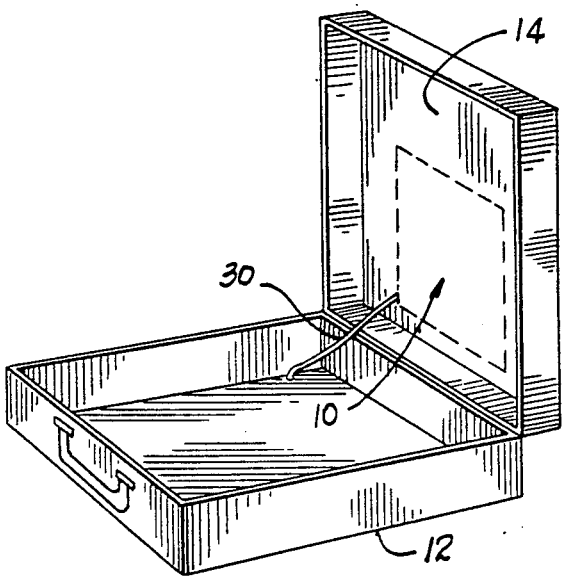
FIG. 1 is a perspective view of a carrying case with an antenna constructed in accordance with the invention attached to one wall.

Turning now to the drawings, FIG. 1 illustrates an antenna structure 10 mounted within a briefcase or carrying case 12. The antenna is shown coupled to a back panel 14 of the carrying case and is preferably painted or coated to blend with the appearance of the back panel 14. In many applications, the back panel will be partially covered by pockets (not shown) which will also cover the antenna structure 10.

Figure 2:
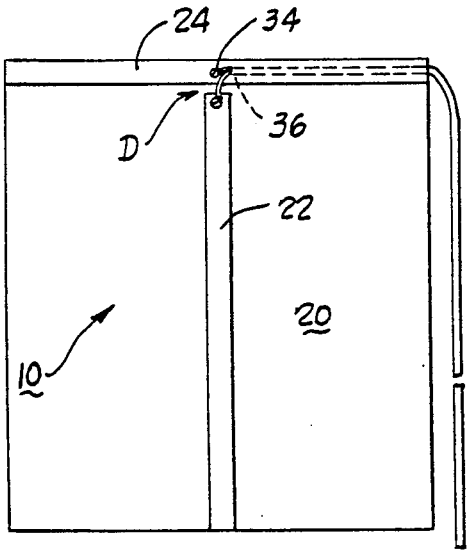
FIG. 2 is a front plan view of an antenna support and two mutually perpendicular conductors mounted to the support, one operating as a radiator and a second operating as a ground-plane.
Figure 3:
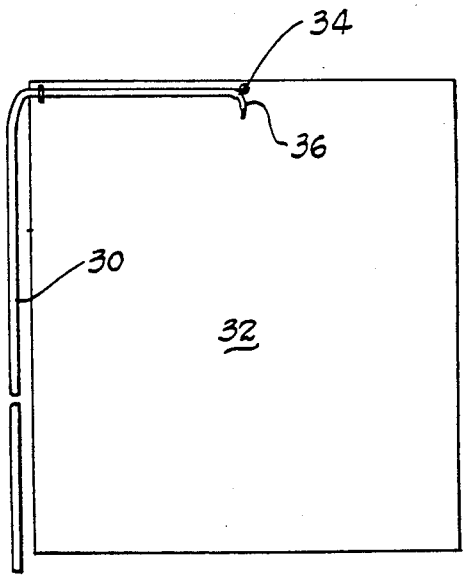
FIG. 3 is a rear plan view of the FIG. 2 support showing a communication cable that is routed to the two conductors of FIG. 2.

Turning to FIGS. 2 and 3, the antenna structure 10 is seen mounted to a substrate 30 of nonconducting material that supports two conductors 22, 24. A first conductor 22 radiates electro-magnetic energy in response to energization signals from a radio (not shown) within the carrying case 12. This conductor 22 is of a length to be a $\frac{5}{8}$ wavelength conductor for frequencies in the cellular telephone range. In one embodiment this conductor 22 has a length of $8\frac{7}{8}$ inches.

The second conductor 24 is a ground-plane conductor which approximates the functioning of ground-planes known in the art. The ground-plane conductor 24, however, is co-planar with the first radiator 22 and is separated from the conductor by a small gap D that is chosen to match the impedance of the antenna 10 to the impedance of an input cable 30.

In a presently preferred embodiment, the cable 30 is routed along a back surface 32 (FIG. 3) of the substrate 20 and individual conductors of the cable 30 are routed through holes formed in the substrate 20. A first conductor 34 passes through a hole in the ground-plane conductor 24 and is soldered near the center of the ground-plane conductor 22. A second conductor 36 passes through the substrate 20 and conductor 22 and is soldered near the end of the conductor 22.

The conductors 22, 24 are preferably constructed from a copper foil tape that is one-half inch wide and two thousandths of an inch thick. The tape is adhesive on one side so that during construction, it is unwound, cut to an appropriate length, and affixed to the supporting substrate 20. A preferred conductive foil tape is commercially available and a preferred substrate 20 is made from cardboard.

Once the conductors have been applied to the substrate 20 and the two conductors 34, 36 soldered in place, the cable 30 is fastened to the back surface 12 of the substrate, the conductor foil is covered with a shrink wrap material which protects the conductors from corrosion and mechanical stress. Once this is accomplished, the entire substrate including shrink wrap protected conductors 22, 24 is painted with a spray paint. It is apparent therefore that the FIG. 2 depiction shows the conductors 22, 24 prior to these other enumerated fabrication steps.

A preferred spacing between the copper strips 22, 24 is approximately one-eighth of an inch. This spacing is chosen so that the impedance created by the spacing between conductors 22, 24 approximately matches the inductive impedance of the conductor 30. This spacing, position and the length of conductor 36 are empirically derived and can be adjusted for other frequencies and conductors/cable configurations. The presently preferred cable 30 is a standard 50 ohm input cable such as RG-58/U used in cellular telephone communication applications. The painted antenna structure 10 is then mounted to the carrying case and in one embodiment this mounting is accomplished with double sided foam tape.

The present invention has been described with a degree of particularity. It is the intent, however, that the invention include all modifications and/or alterations from the disclosed design falling within the spirit or scope of the appended claims.

I claim:

1. An antenna suitable for mounting to a non-conductive flat surface comprising:

a planar substrate of electrically nonconducting material;

a first elongated rectangular conductor mounted to one side of the planar substrate and having a length for radiating electromagnetic energy of a predetermined frequency range in response to a radio signal and for receiving electromagnetic energy of said predetermined frequency range for conversion to a radio signal;

a second elongated ground plane conductor mounted to said one side of the planar substrate, oriented at a right angle to said first conductor, and having a mid-portion spaced from one end of the first elongated conductor; and cable means having a radio signal carrying conductor coupled to the first elongated conductor and a ground conductor coupled to the second elongated conductor;

said ground plane mid-portion spaced from the one end of said first conductor for impedance matching the cable means to said antenna.

2. The antenna of claim 1 where the signal cable means comprises a two wire cable having one wire electrically connected to the first elongated conductor and a second wire electrically connected to the second elongated conductor, said cable attached to said planar substrate.

3. The antenna of claim 1 where the first and second elongated conductors comprise first and second rectangular conductors and where one end of the first conductor is spaced from a midportion of the second conductor by a distance dependant upon the inductive impedance of the cable means.

4. The antenna of claim 3 where the length of the first elongated conductor is such that said conductor comprises a $\frac{5}{8}$ wavelength radiator for signals of the cellular telephone transmission range.

5. The antenna of claim 3 where the first and second elongated conductors are embedded in the planar substrate.

6. A planar, fractional wavelength antenna coupleable to a radio that sends and receives signals comprising a flat electrically nonconducting support member, two generally flat, rectangular, elongated electrically conductive elements mounted to one side of the support member and oriented at right angles to each other with one end of a first conductive element spaced from a midpoint of a second conductive element, and a cable having two insulated conductors attached to the support member wherein an end of a first conductor is electrically connected to said first conductive element and an end of a second of said condutors electrically connected to the second element, said first conductor for transmitting communications signals from the radio to be radiated by said first conductive element and for transmitting communications signals received by the first conductive element to the radio, and the second conductor for grounding said second conductive element.

7. The antenna of claim 6 where the antenna is a $\frac{5}{8}$ wavelength antenna in a cellular telephone communications signal range.

8. The antenna of claim 6 wherein the first and second conductive elements comprise copper foil adhesively coupled to the support member, spaced a distance to impedance match the insulated cable to the antenna.

9. The antenna of claim 6 where the first conductor is electrically connected to the first conductive element near one end of said first conductive element and the second conductor is electrically connected to the second conductive element near a midpoint of the second conductive element.

10. A method for manufacturing a ground-plane antenna comprising the steps of:

mounting a first flat elongated electrically conductive metal foil to one side of a flat nonconducting substrate;

mounting a second flat elongated electrically conductive metal foil to said one side of said flat substrate, spaced from the first elongated conductor and oriented so that the first metal foil extends at a right angle with respect to the second metal foil and is separated from said second metal foil near a midpoint of said second metal foil by a predetermined distance for controlling the impedance of said antenna;

securing a signal carrying cable having two conductors to said substrate;

electrically coupling a first conductor to the first metal foil; and electrically coupling a second conductor to said second metal foil.

11. The method of claim 10 where the the signal carrying cable is routed through the substrate for electrical connection to said first and second metal foils.

* * * * *